United States Patent [19]

Sells

[11] 3,949,657

[45] Apr. 13, 1976

[54] VENTILATED CAP FOR THE RIDGE OF A ROOF

[76] Inventor: Gary L. Sells, 16250 Petro Drive, Mishawaka, Ind. 46544

[22] Filed: Apr. 22, 1974

[21] Appl. No.: 462,716

[52] U.S. Cl. ..... 98/42 A; 52/199; 52/302

[51] Int. Cl.[2] ..... F24F 7/02

[58] Field of Search ..... 98/42, 29, 33 A, 45, 46, 98/66 R, DIG. 2, 82, DIG. 6, 83, 42.1; 52/57, 301, 302, 199, 198, 518; 137/533.17, 533.19

[56] References Cited

UNITED STATES PATENTS

| | | | |
|---|---|---|---|
| 1,230,305 | 6/1917 | Klay | 52/302 |
| 2,060,002 | 11/1936 | Brinkley | 98/42.1 |
| 2,207,671 | 7/1940 | King | 98/42 |
| 2,214,886 | 9/1940 | McKeown | 52/199 |
| 2,566,784 | 9/1951 | Waff, Jr. | 98/42 |
| 2,579,662 | 12/1951 | Gibson | 98/42.1 |
| 2,737,876 | 3/1956 | Smith | 98/42 |
| 2,782,129 | 2/1957 | Donegan | 52/518 |
| 2,847,948 | 8/1958 | Truitt | 52/518 |
| 2,868,104 | 1/1959 | Honholt et al. | 98/42.1 |
| 3,073,235 | 1/1963 | Smith et al. | 98/42.1 |
| 3,236,170 | 2/1966 | Meyer et al. | 98/42.1 |
| 3,311,047 | 3/1967 | Smith et al. | 98/42 |
| 3,481,263 | 12/1969 | Belden | 98/42 |
| 3,625,134 | 12/1971 | Smith | 98/42 |

*Primary Examiner*—William F. Wayner
*Assistant Examiner*—Henry C. Yuen
*Attorney, Agent, or Firm*—Oltsch & Knoblock

[57] ABSTRACT

A ventilated cap which is placed over the opening in the ridge of a roof and which includes a pair of beveled edged vent parts. Each vent part has transversely oriented openings therein which extending from one beveled side edge to the other of the part. The vent parts are placed side edge to side edge over the opening in the roof ridge and secured to the underlying roof sides. Shingles are placed over the top of the vent parts in overlapping fashion with the outer beveled side edges of the parts being exposed but underlying said shingles to vent said roof.

4 Claims, 3 Drawing Figures

Fig. 1
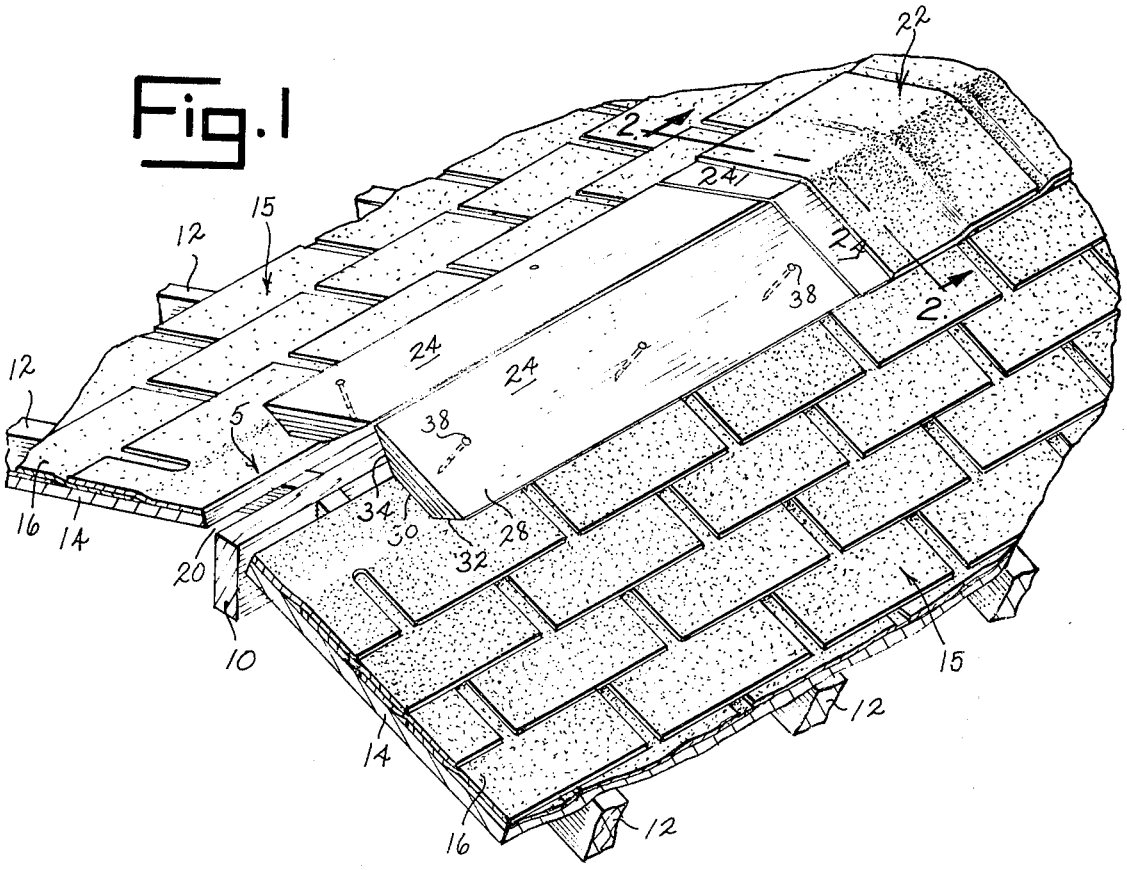
Fig. 2
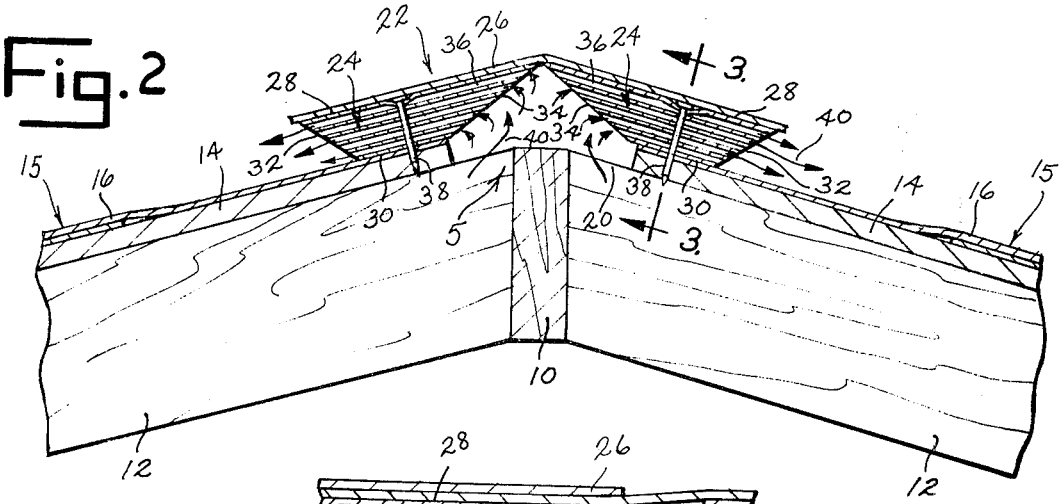
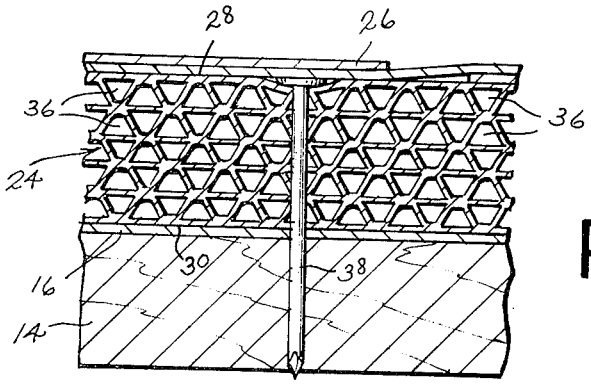
Fig. 3

VENTILATED CAP FOR THE RIDGE OF A ROOF

SUMMARY OF THE INVENTION

This invention relates to a ventilated cap for the ridge of a roof and also has application to the method of manufacturing and applying such a cap.

The ventilated cap of this invention includes a pair of elongated vent parts each having upper and lower surfaces and inner and outer side edges which are beveled and which taper from the top surface to the bottom surface of the part. A plurality of vent openings extend transversely through each vent part from one side edge to the other. The ridge of the roof has a longitudinal opening formed therein with a vent part being located at each side of the ridge opening and having the lower surface thereof in contact with a roof side. The inner beveled side edge of each vent part overlies at least a part of the ridge opening and is positioned adjacent the corresponding inner beveled side edge of the other vent part. Shingles are applied over the vent parts with the outer beveled side edge of each vent part being exposed so as to permit air to flow through the openings in the vent parts from the ridge opening. The vent parts may be economically formed from corrugated cardboard coated with a sealant material to protect the cardboard from moisture. The vent parts and overlying shingles of the ventilated cap may be attached to the roof by the use of roofing nails and in a rapid and simple manner. By utilizing the same color and type of shingles to cover the vent parts of the cap as are used upon the sides of the roof, the cap can be made to blend into the roof sides and become essentially unnoticeable so as not to detract from the appearance of the house or building structure to which the cap is attached.

Accordingly, it is an object of this invention to provide a ventilated cap which is for the ridge of a roof and which is of economical construction.

Another object of this invention is to provide a ventilated cap for the ridge of a roof in which the cap may be applied to the roof through the use of roofing nails in a simple and rapid manner.

Another object of this invention is to provide a method of constructing an economical and efficient ventilated cap which may be applied to the ridge of a roof.

Still another object of this invention is to provide a ventilated cap which when applied to the ridge of a roof blends into the sides of the roof so as to be substantially unnoticeable.

Other objects of the invention will become apparent upon a reading of the invention's description.

BRIEF DESCRIPTION OF THE DRAWINGS

A preferred embodiment of this invention has been chosen for purposes of illustration and description wherein:

FIG. 1 is a fragmentary view of a roof showing the ventilated cap of this invention being applied over an opening in the ridge of the roof.

FIG. 2 is a fragmentary cross sectional view taken along line 2—2 of FIG. 1.

FIG. 3 is a detailed fragmentary sectional view taken along line 3—3 of FIG. 2.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

In the figures illustrated, a roof having a ridge 5 is shown in fragmentary form. The roof includes a ridge board 10 to which is connected a plurality of longitudinally spaced inclined rafters 12. Roof sheeting 14 covers rafters 12. Shingles 16 are applied over sheeting 14 to form the sides 15 of the roof. At the roof ridge 5 sheeting 14 and overlying shingles 16 terminate spacedly from ridge board 10 so as to provide an opening 20 which extends along each side of ridge board 10 and into the interior of the structure over which the roof is applied.

The ventilated cap 22 of this invention includes a pair of vent parts 24 over which are applied shingles 26. Each vent part 24 includes an upper surface 28, a lower surface 30, an outer side edge 32 and an inner side edge 34. Side edges 32 and 34 are each beveled and taper from upper surface 28 to lower surface 30. The angle of taper of side edge 32 is preferably approximately 45° relative to upper surface 28 but may range between 30° and 60°, depending upon the shape of roof sides 15. The angle of taper of side edge 34 is preferably around 25° relative to upper surface 28 but may vary between 15° and 60°. A plurality of openings 36 extend from outer side edge 32 to the inner side edge 34 of each vent part 24. Openings 36 preferably parallel one of the upper or lower surfaces 28 or 30 of the vent part.

Vent parts 24 may be formed of a molded plastic material or, preferably, from corrugated cardboard which after being cut to size is then dipped or otherwise coated with a sealant, such as an epoxy paint, to protect the carboard material from deterioration due to moisture and similar elements.

After opening 20 in the roof ridge 5 has been formed and the shingles 16 applied to the sides 15 of the roof, vent parts 24 are applied. The vent parts, which may vary in length but which are preferably of a four to five-foot length for convenient handling, are placed end to end on each side of opening 20 with the longitudinal dimensions of the vent parts generally paralleling opening 20 and with lower surface 30 of each vent part contacting the underlying shingles 16 which have been applied over roof sheeting 14 to the ridge opening. A saw may be used to cut those vent parts 24 formed of coated cardboard to length. The inner side edges 34 of the vent parts are positioned in an opposed relationship to one another and overlie opening 20 in ridge 5. Depending upon the size of opening 20, a portion of the lower surfaces 30 of the vent parts may also overlie the ridge opening. Side edges 34 are located in close proximity to one another, and may actually contact at the upper surfaces 28 of the vent parts to form a cooperating inverted V-shaped configuration. Vent parts 24 may be secured to the underlying roof sides 15 by means of roofing nails 38 which are driven through the vent parts and into the underlying roof sheeting 14.

Once vent parts 24 are secured over ridge opening 20, shingles 26, which are preferably of like composition and color to those shingles 16 covering roof sheeting 14, are cut and applied over the upper surfaces 28 of the vent parts. Shingles 26 are caused to overlap one another and extend in one piece form across both vent parts from one outer side edge 32 to the other outer side edge 32 of the vent parts. Shingles 26 may be applied to vent parts 24 by nailing, which is commonly utilized in applying shingling to an underlying supporting structure, or by gluing. The ends of the vent parts 24 and overlying shingles 26 at the ends of the roof ridge may be covered by shingle caps or metal roof edging (neither shown).

As best illustrated in FIG. 2, opposing inner side edges 34 of vent parts 24 form a vent inlet through which air from under the roof may pass upwardly through ridge opening 20 and into openings 36 in the vent parts to exit at side edges 32 as shown by the arrows 40 in the figures. The bevel of outer side edges 32 prevents wind-driven rain and snow from being forced upwardly through openings 36 in the vent caps and into ridge opening 20. Vent part openings 36, which in the case of cardboard constructed vent parts will be the flutes formed by the corrugation and which are shown in FIG. 3, are approximately 1/8 inch or smaller in size so as to be large enough to accommodate the flow of air through the vent part but sufficiently small to prevent flying insects, such as flies, from obtaining access to opening 20 in roof ridge 5. In this manner it will not be necessary to utilize a separate insect screen in conjunction with the ventilated cap. It is to be further understood that the ventilated cap above described may be utilized on a variety of roofs, including hip roofs, where the cap may follow the incline or hip line of the roof. In this inclined orientation the smallness of vent part openings 36 prevents rain and snow from entering the cap. By utilizing shingles of the same type and color as the underlying shingles 16 covering the sides of the roof the cap will be caused to blend in with the roof and be substantially unnoticeable while still performing its venting function.

It is to be understood that the invention is not to be limited to the details above given but may be modified within the scope of the appended claims.

What I claim is:

1. A ventilated cap for the ridge of a roof, said roof having opposed sides tapering upwardly to said ridge, said ridge having a longitudinal opening therein, said cap comprising a pair of elongated vent parts, each vent part having upper and lower surfaces and inner and outer side edges which extend between said surfaces along the longitudinal dimension of the parts, said side edges of each vent part being beveled and tapering from the upper surface to the lower surface of the part, a plurality of narrow elongated tubular vent opening means for excluding insects and wind driven moisture extending transversely through each vent part from the inner side edge to the outer side edge thereof, a said vent part located on each side of said ridge opening and having the lower surface thereof in contact with a roof side with the vent part generally paralleling said ridge, said inner side edges of the vent parts positioned adjacent to each other at the upper surfaces of the parts and overlying said ridge opening, other shingles overlying the upper surfaces of said vent parts and extending thereacross from one said outer side edge to the other said outer side edge of the parts and terminating spacedly above said roof sides, wherein the taper of said inner side edges of each vent part is between 15° and 60° relative to said upper surface of the part, said taper of said outer side edges of each vent part is between 30° and 60° relative to said upper surface of the part.

2. The ventilated cap of claim 1 wherein said vent openings parallel one of said upper and lower surfaces of each vent part.

3. A ventilated cap for the ridge of a roof, said roof having opposed sides tapering upwardly to said ridge, said ridge having a longitudinal opening therein, said cap comprising a pair of elongated vent parts, each vent part having upper and lower surfaces and inner and outer side edges which extend between said surfaces along the longitudinal dimension of the part, said side edges of each vent part being beveled and tapering from the upper surface to the lower surface of the part, a plurality of vent openings extending transversely through each vent part from the inner side edge to the outer side edge thereof, each vent part being of a corrugated cardboard construction coated with a moisture impervious substance, said vent openings being flutes defined by the corrugations in the cardboard, a said vent part located on each side of said ridge opening and having the lower surface thereof in contact with a roof side with the vent part generally paralleling said ridge, said inner side edges of the vent parts positioned adjacent to each other at the upper surfaces of the parts and overlying said ridge opening, other shingles overlying the upper surfaces of said vent parts and extending thereacross from one said outer side edge to the other said outer side edge of the parts and terminating spacedly above said roof sides.

4. The ventilated cap of claim 1 wherein the inner side edges of said vent parts adjoin each other at the upper surfaces of the parts when overlying said ridge opening.

* * * * *